US005568869A

United States Patent [19]

Turkenich et al.

[11] Patent Number: 5,568,869

[45] Date of Patent: Oct. 29, 1996

[54] METHODS AND APPARATUS FOR MAKING CONTINUOUS MAGNETIC SEPARATIONS

[75] Inventors: Alexander M. Turkenich; Yevgeny S. Lapshin, both of Dniepropetrovsk; Raphael S. Ulubabov, Lugansk; Vladimir I. Dudnik, Dniepropetrovsk, all of Ukraine; Jens Dahl, Browns Mills, N.J.

[73] Assignee: S.G. Frantz Company, Inc., Trenton, N.J.

[21] Appl. No.: 349,896

[22] Filed: Dec. 6, 1994

[51] Int. Cl.[6] ..... B03C 1/00

[52] U.S. Cl. ..... 209/212; 209/214; 209/228; 209/232

[58] Field of Search ..... 209/212, 214, 209/223.1, 213, 223.2, 231, 232, 39, 225, 228, 226, 227; 210/222, 223

[56] References Cited

U.S. PATENT DOCUMENTS

| | | | |
|---|---|---|---|
| 2,056,426 | 10/1936 | Frantz | 209/232 |
| 4,235,710 | 11/1980 | Sun | 209/232 X |
| 4,663,029 | 5/1987 | Kelland et al. | 209/212 X |
| 4,668,383 | 5/1987 | Watson | 209/232 X |
| 4,828,711 | 5/1989 | Cohen | 209/232 X |
| 4,941,969 | 7/1990 | Schonert et al. | 209/232 X |

OTHER PUBLICATIONS

K. Schonert al. al., *Repulsion Magnetic Separator for Weak Paramagnetic Materials in the Fine Size Range,* XVI Int'l Mineral Procressing Cong. (1988).

Translation of Czech Patent No. 227 800, filed on Feb. 21, 1983, issued on Nov. 1, 1985, to V. Zezulka et al.

J. Svoboda, *Magnetic Methods for the Treatment of Minerals,* p. 286 (Elzevier Science Publishers B.V., 1987).

*Primary Examiner*—William E. Terrell
*Assistant Examiner*—Tuan Nguyen
*Attorney, Agent, or Firm*—Brumbaugh, Graves, Donohue & Raymond

[57] ABSTRACT

Magnetic separations are made by feeding material to a magnetic separator having elongated ferromagnetic bodies that are disposed parallel to each other with spaces therebetween, the bodies being disposed at an angle to the magnetic field direction. The magnetic particles are deflected away, while the nonmagnetic particles pass through the spaces between the ferromagnetic bodies. In one embodiment, the separator includes a magnetic circuit including an array of elongated ferromagnetic bodies, parallel to each other with spaces therebetween, and on the same side of a common tangential plane that is positioned substantially perpendicular to the direction of the field created by the magnetic system and at an acute angle to the direction of particle feed towards the ferromagnetic bodies. The separator also includes a material feeder, a discharge channel for collecting nonmagnetic product mounted on the opposite side of the common tangential plane array, means for collecting magnetic product, and liquid supply channel separated from the feeder by a divider extending into the separation chamber. To enhance separation, a separate stream of clean liquid is introduced into the separation chamber through the liquid supply channel, so that the liquid stream encounters the stream of material undergoing separation.

48 Claims, 7 Drawing Sheets

METHODS AND APPARATUS FOR MAKING CONTINUOUS MAGNETIC SEPARATIONS

BACKGROUND OF THE INVENTION

1. Field of the Invention

The present invention relates in general to magnetic separation and, in particular, to improved methods and apparatus for making continuous magnetic separations of flowable mixtures of particles of different magnetic susceptibilities.

2. Background of the Prior Art

A ferromagnetic body magnetized in a magnetic field exerts either attractive or repulsive magnetic forces on particles in its vicinity depending on the position and the susceptibility of the particles. For example, the direction in which magnetic force urges paramagnetic and ferromagnetic particles is opposite to that in which it urges diamagnetic particles. In the following description, the effects of magnetic force on particles having appreciable positive magnetic susceptibility, such as paramagnetic and ferromagnetic particles, is considered. The word "magnetic," as hereinafter used to describe particles, should be understood to mean particles having appreciable positive susceptibility unless otherwise specified. The word "nonmagnetic", as hereinafter used to describe particles, should be understood to mean particles which are diamagnetic or which have positive susceptibility too weak to be exploited for separation purposes.

Magnetic flux concentrates in a ferromagnetic body and in regions adjacent to the opposite sides where it enters and leaves the body, i.e., in the poles induced in the body. Attractive magnetic forces approximately aligned with field direction and directed toward the ferromagnetic body arise in the regions of concentration of magnetic flux, while repulsive magnetic forces arise at the other sides of the ferromagnetic body, i.e., in the spaces between the regions of attraction, and are oriented roughly perpendicular to magnetic field direction. In these regions of repulsion, the field intensity is below the average value of the field and field gradients increase for a slight distance from the ferromagnetic body and then decrease with further distance from it. The repulsive forces in these regions act substantially at right angles to the surface of the ferromagnetic body. While the attractive magnetic forces are strongest at the polar regions of the surface of the ferromagnetic body, the repulsive magnetic forces are strongest at a short distance away from the surfaces of the ferromagnetic body between the polar regions.

Most of the known magnetic separation techniques are based on the attraction of magnetic particles to a ferromagnetic body matrix. Thus, repulsive magnetic forces generated in the matrix are incidental to the separation process. Because, in many of these known separators, the magnetic particles must be washed off the ferromagnetic bodies, the material must be fed in batches. In other words, feeding is interrupted periodically.

In a prior art technique, the matrix comprises an array of elongated ferromagnetic bodies which are disposed parallel to each other and spaced apart from each other and disposed in a plane perpendicular to the magnetic field. Material fed to the matrix flows toward the ferromagnetic bodies so that nonmagnetic particles pass through the spaces between them, while magnetic particles are attracted to them and held on their surfaces. The ferromagnetic bodies must be withdrawn from the magnetic field and washed to recover the magnetic fraction.

In this method, the magnetic field is oriented with respect to parallel ferromagnetic bodies so that regions of attractive magnetic force arise at the surfaces where magnetic flux enters and leaves the bodies, whereas repulsive magnetic force directed away from the surfaces between the regions of attractive force arise in the spaces between the ferromagnetic bodies. Thus, the material approaching the ferromagnetic bodies first enters regions of attractive force, where magnetic particles are attracted to the ferromagnetic bodies while nonmagnetic particles pass through the spaces between them and are concentrated as the nonmagnetic fraction. Magnetic particles not attracted to the ferromagnetic bodies which enter the spaces between them are not separated by repulsive force because means are not provided to collect and discharge them.

This technique is embodied in a device which includes a magnetic circuit and a rotor supporting arrays of parallel elongated ferromagnetic bodies disposed in a plane perpendicular to field direction. Material is fed through this array of ferromagnetic bodies, where magnetic particles are held, while nonmagnetic particles pass through the spaces between them. However, the rotor, which is essential to the operation of the device, diminishes its reliability while increasing size, weight and power consumption.

Similarly, another technique employs grids of spaced-apart parallel elongated ferromagnetic bars inclined at an acute angle to the vertical exit direction and disposed in a plane parallel to field direction and magnetized in a horizontal magnetic field. When material is fed to the separator, magnetic particles are captured on the bars of the grids, while nonmagnetic particles pass downward through them. Continuous feeding is obtained by employing means to move a succession of matrices continuously in and out of the field.

Magnetic separation techniques based on repulsion of magnetic particles by a ferromagnetic body in a magnetic field have been reported. Generally, the material is fed to separators continuously since magnetic particles do not have to be washed off the ferromagnetic bodies. These magnetic separation methods are hereinafter sometimes referred to as continuous methods.

A prior art method of continuous separation of weakly magnetic materials by means of repulsive magnetic forces includes providing a magnetic field perpendicular or nearly perpendicular to elongated ferromagnetic bodies positioned in a plane which is parallel to field direction and adjacent to the separating chamber, feeding material into the regions of repulsion adjacent to the ferromagnetic bodies and moving the material within said regions along the length of the ferromagnetic bodies in order to deflect magnetic particles away from the ferromagnetic bodies by the action of the repulsive magnetic forces, and continuously removing the separated fractions, the magnetic particles into collection means positioned at a distance from the ferromagnetic bodies and the nonmagnetic particles into collection means positioned near the lower ends of the ferromagnetic bodies.

However, the repulsive magnetic force in a region of repulsion near the surface of a ferromagnetic body is typically about a quarter as strong as the attractive magnetic force in a region of attraction at the surface of the same body. In addition, the repulsive force becomes weaker with distance from the ferromagnetic body. Therefore, the repulsive magnetic force is too weak to separate the streams of magnetic and nonmagnetic particles sufficiently to prevent cross contamination.

Another prior art method for the continuous separation of weakly magnetic materials by means of repulsive magnetic forces includes providing a magnetic field perpendicular or nearly perpendicular to elongated ferromagnetic bodies positioned in a plane which is parallel to the field direction adjacent to and below the separating chamber, feeding material into the regions of repulsion adjacent to the ferromagnetic bodies and moving the material within said regions along the length of the ferromagnetic bodies in order to deflect magnetic particles away from them and upwards from the lower edge of the field, while the nonmagnetic particles sink towards said lower edge, and continuously removing the separated fractions, the magnetic particles passing out of the field above a mechanical divider and the nonmagnetic particles passing out of the field below the divider.

This prior art method of continuous separation, because it employs repulsive magnetic force to lift particles only a few millimeters away from the lower wall of the chamber to which nonmagnetic particles sink, is capable of effecting separation with less cross contamination than is the method previously described. Reports acknowledge, however, that some cross contamination occurs. This is attributable to the fact that the floor of the chamber prevents the material to be separated from entering the region of maximum repulsive magnetic force, where weakly magnetic particles could be deflected away from nonmagnetic particles moving under gravitational force.

Finally, another prior art method and apparatus employs a locus of maximum magnetic energy gradient, HdH/dX, transverse to the field direction at the midplane of a gap between matched pole pieces, which serves as a magnetic barrier. Material is fed onto the midplane so that it moves under gravitational or other nonmagnetic force toward the magnetic barrier, where particles having susceptibilities above a selected value are deflected along its length, while particles having susceptibilities that are lower or of opposite sign pass through the barrier. With this method, ferromagnetic particles can also be separated continuously at the barrier according to differences in their magnetic properties, since magnetic force aligned with field direction is weak compared with transverse magnetic force.

Limitations on processing capacity result because conditions for separation are only optimal at the midplane between the pole pieces. Transverse magnetic force decreases and magnetic force aligned with field direction increases as particles approach a pole piece. Thus, while feeding of material through the barrier field as a thin, well dispersed stream is consistent with good separation, the apparatus' efficiency drops with thicker, less dispersed streams.

SUMMARY OF THE INVENTION

It is an object of the present invention to provide improved methods and apparatus for separating mixtures containing magnetic materials by eliminating the attraction of magnetic particles to the ferromagnetic bodies and providing for the continuous deflection of the particles away from the ferromagnetic bodies and away from the paths of nonmagnetic particles, thereby providing continuous separation with high output and little cross contamination of the separation products.

This objective is attained by feeding particulate materials to elongated ferromagnetic bodies that are disposed in parallel, with spaces therebetween, on the same side of a common plane, with the bodies and the plane being disposed at an angle substantially perpendicular (from 75° to 90°) to the magnetic field direction and at an acute angle to the particle feed direction. The material is fed towards the ferromagnetic bodies in one or more streams with the intervals between the streams being aligned with the ferromagnetic bodies and the streams themselves being aligned with the spaces between the bodies. The magnetic particles are then deflected away from the ferromagnetic bodies in the direction (relative to the common plane of the bodies) from which the material is fed, while the nonmagnetic particles pass through the spaces between the ferromagnetic bodies.

In one embodiment of a separator constructed in accordance with the invention, the separator includes a magnetic circuit including one or more arrays of elongated ferromagnetic bodies mounted in a separation chamber located in the gap between opposed pole pieces. The ferromagnetic bodies in each array are arranged parallel to each other in a common plane with spaces therebetween. As aforementioned, this plane is positioned at an angle substantially perpendicular to the direction of the field created by the magnetic system. Additionally, the separator has a feeder for feeding particulate material to be separated, nonmagnetic means for guiding the material approaching the ferromagnetic bodies towards the spaces between the bodies, means for collecting nonmagnetic product and means for collecting magnetic product. The common plane is disposed at an acute angle to the direction from the feeder to the collection means for nonmagnetic product. The feed material may be either dry or in the form of a slurry.

In another embodiment, the separator is also equipped with liquid supply means separated from the material feeder by a divider extending into the separation chamber. Preferably, a separate stream of clean wash liquid is introduced into the separation chamber through the liquid supply means so that the wash stream encounters the stream of material undergoing separation. The divider is preferably substantially vertical, so that if extended it would intersect the plane of the ferromagnetic bodies, thus directing the wash stream toward the stream of deflected magnetic material.

In a basic embodiment of the invention, the ferromagnetic bodies are formed as inclined rods. Each rod has a protective shield of nonmagnetic material, which is attached to the side of the rod facing the direction from which material is fed and, if desired, to the opposite side as well.

In another embodiment of the invention, a second array of rods similar to the array provided in the basic embodiment of the invention, rotated 180° about the vertical axis passing through the center of the array, is mounted adjacent to the pole face opposite to the basic array. A material input channel and a nonmagnetic particle exit channel are associated with each array of ferromagnetic rods, with a central wash liquid supply channel and a central magnetic fraction discharge channel being located between the two nonmagnetic particle exit channels.

In another embodiment of the invention, the ferromagnetic bodies are formed as triangular plates. The apex of each plate is located near the material feed end of the separation chamber, while an edge of the plate, hereinafter called the back edge, adjoins a ferromagnetic back plate and is preferably joined as an integral whole therewith. The back plate is parallel and adjacent to one of the opposed faces of the pole pieces of the magnetic circuit. A second edge of each ferromagnetic plate, hereinafter called the front edge, joins the back edge to form the apex and faces towards the opposite pole face. Each front edge extends inward from the back edge at a suitable angle (from 75° to 90° to the magnetic field direction), and all front edges are on the same side of a common plane. The third edge of each triangular plate joining the back and front edges, hereinafter called the base edge, is at the opposite end of the separation chamber from the feed end and near the collection channels for separated fractions. The apex and the junction between the base and front edges of the plates are rounded to form the shape of a second order convex curve having a suitable radius (>⅜ inch and preferably >½ inch). Alternatively, and in particular when the mixture to be separated contains strongly magnetic particles, the curve at the junction between base and front edge of each plate may be isodynamic in order to reduce field gradient resulting from the decline in field intensity in the direction towards said junction, thereby moderating attractive magnetic force opposing the movement of magnetic particles toward the discharge channel. The front edge of each ferromagnetic plate is rounded off in cross section, and has a protective shield of nonmagnetic material attached to it. The thickness of the triangular plates can be such that an array of two of them is less than or substantially equal to the width of the pole pieces.

In another embodiment of the invention, a second array of triangular plates similar to the basic array provided in the embodiment of the invention last described, rotated 180° about the horizontal axis perpendicular to field direction passing through the center of the gap, is mounted adjacent to the pole face opposite to the basic array.

In another embodiment of the invention, three arrays of triangular plates are provided. A first array is similar in shape to the basic array of the two preceding embodiments, but rotated 180° about the horizontal axis parallel to field direction so that the base edge of each plate is near the material feed end of the separation chamber and its front edge extends downward and outward towards one of the opposed pole faces to a junction with its back edge at the opposite end of the chamber. The back edges and the back plate to which they are joined are parallel and adjacent to the pole face. A second array similar to the first array, rotated 180° about the vertical axis passing through the center of the array, is mounted adjacent to the pole piece opposite to the first array.

A third array of parallel ferromagnetic plates, each an isosceles triangle, with spaces therebetween, is provided between the first and second arrays. Edges of each plate forming the equal sides of the triangle, hereinafter called the isosceles edges, converge at an apex near the material feed end of the chamber, and the third edge joining the isosceles edges, hereinafter called the base edge, is at the opposite end of the chamber and parallel with field direction. The junctions between edges of the plates are rounded to form the shape of a second order convex curve having a suitable radius (>⅜ inch and preferably >½ inch). Alternatively, the isosceles edges may terminate in an isodynamic curve where they join the base edge. The isosceles edges of each plate are rounded off in cross section, nonmagnetic members with the inner walls forming a channel equal in width to or narrower than the space between the plates are fitted to the edges, and extend the edges so that they converge to a point at the apex. Each isosceles edge of each plate is on the same side of a common plane, one of such planes being parallel to the common plane of the front edges of the first array and the other being parallel to the common plane of the front edges of the second array. The plates of the three arrays and the spaces between them are aligned. The plates of the third array are joined at the vertical axis by ferromagnetic bars extending from a point somewhat removed from the apex to base edge, with such bars preferably forming an integral whole with the plates. The separator has a material feed channel at the center of the separating chamber above the apex of the third array of triangular plates and a separate liquid supply means with two input channels, each separated from the feed channel by a divider extending into the chamber to a level below the apex, one on each side thereof and both equidistant therefrom. A discharge channel for nonmagnetic particles is provided below the base edge of the third array, and discharge channels for magnetic particles are provided at each side of the chamber outward from the ends of the base edge of the third array.

In another embodiment three arrays of triangular plates similar to those of the preceding embodiment are rotated 180° about the horizontal axis aligned with field direction so that the apex of each plate of the first and second arrays and the base edge of each plate of the third array is near the feed end of the separating chamber. The separator has two material feed channels, one at each side of the separating chamber, and a separate liquid supply means with an input channel centered between the feed channels and separated therefrom by dividers which extend into the chamber on each side of the third array to a level below the junctions between isosceles and base edges. A discharge channel for magnetic particles is provided at the center of the chamber below the inverted apex of the third array, and two discharge channels for nonmagnetic particles are provided, one at each side of the chamber below the base edges of the first and second arrays.

In the foregoing and other embodiments, the outer surfaces of the outermost ferromagnetic bodies are preferably contiguous with the inner surfaces of the separation chamber and form a seal therewith. Alternatively, the outer surfaces of the outermost ferromagnetic bodies themselves define the boundary of the separation chamber. Each protective shield is preferably equal in width to or wider than the thickness of the ferromagnetic body to which it is attached, or it preferably forms a wall of a channel equal in width to or narrower than the space between the ferromagnetic bodies.

Finally, in addition to fulfilling the object of the invention, the means and methods of the invention provide continuous separation while obviating the need for a separate rotor or other means for a cleaning cycle.

BRIEF DESCRIPTION OF THE DRAWINGS

For a better understanding of the invention, reference may be made to the following description of exemplary embodiments thereof, in conjunction with the accompanying drawings in which.

DETAILED DESCRIPTION

Figure 1:
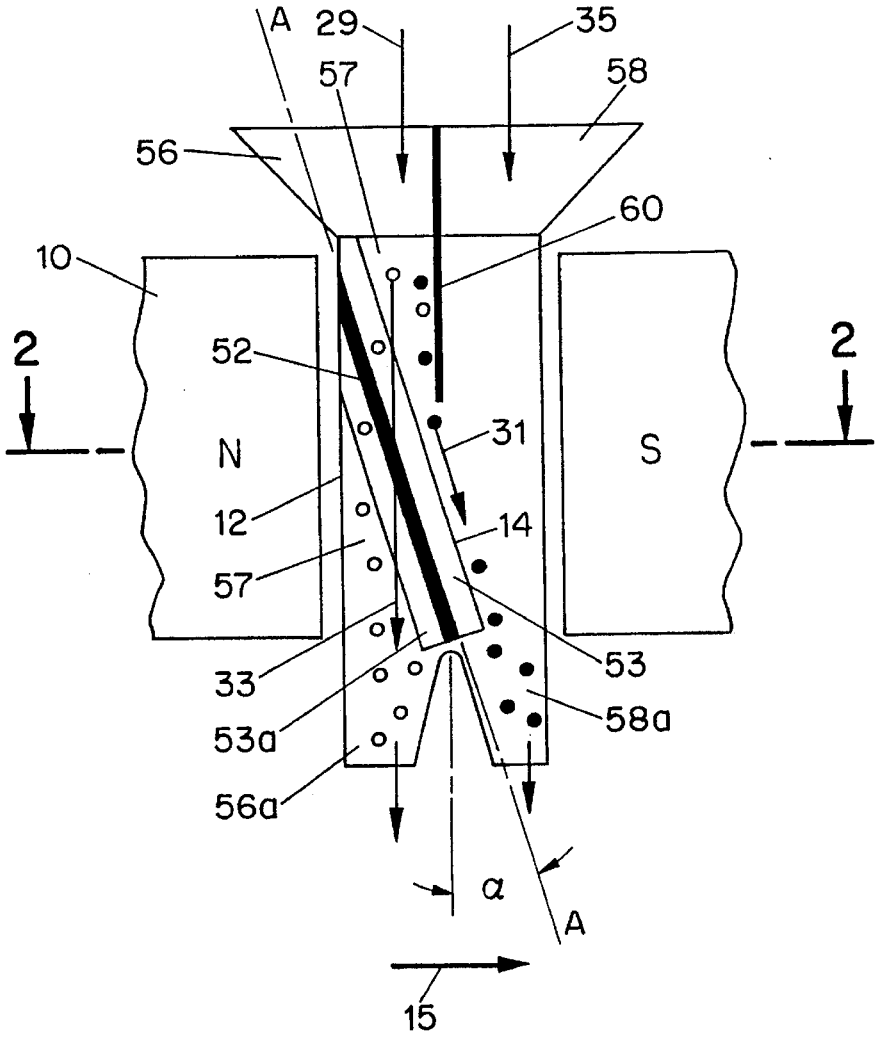
FIG. 1 is a schematic view of a first embodiment according to the present invention.
Figure 2:
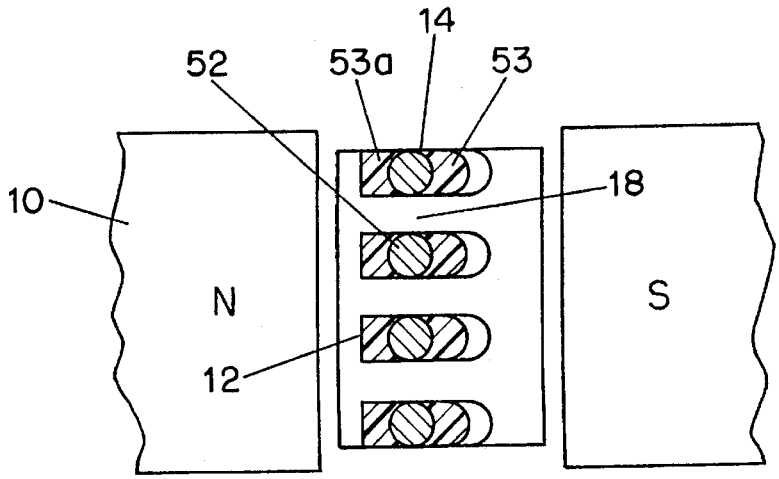
FIG. 2 is a sectional view taken along line 2—2 of FIG. 1 and looking in the direction of the arrows.

As shown in FIGS. 1 and 2, one embodiment of a separator constructed in accordance with the invention includes a magnetic circuit 10, e.g., having opposed North (N) and South (S) poles and a separation chamber 12 mounted in the gap between the pole faces. The separation chamber 12 includes and surrounds one or more arrays 14 of elongated ferromagnetic bodies in the form of elongated rods 52. The separation chamber 12 may be fabricated in whole or in part of any desired nonmagnetic material. Clear plastic may be used as the nonmagnetic material to provide visibility. The ferromagnetic bodies may be joined with such nonmagnetic material to form parts of the chamber walls.

In each array 14, the rods 52 are arranged parallel to each other with spaces 18 between them. As shown in FIG. 1, the rods are arranged in a common tangential plane A—A that is substantially perpendicular to the direction of the magnetic field, which is indicated in FIG. 1 by the arrow 15. In accordance with the invention, the angle of inclination $\alpha$ of the plane A—A relative to the perpendicular to the magnetic field is within the range of from 2° to 15° and preferably within the range of from 4° to 10°. The separator also comprises a material feed channel 56, a magnetic fraction discharge channel 58*a*, a liquid supply channel 58, and a nonmagnetic fraction discharge channel 56*a*. The material feed channel 56 and the nonmagnetic fraction discharge channel 56*a* connect to form a channel 57.

The rods 52 are fitted with nonmagnetic shields 53, 53*a* of a thickness equal to or greater than the rod diameter. As shown in FIG. 2, such shields can be attached to the rods not only on the side from which material is fed, or front side, (shields 53) but also on the opposite, or back side, (shields 53*a*) to prevent collection on the rods of magnetic particles that have penetrated the spaces therebetween. The outer surfaces of the two outermost rods 52 and the associated shields 53, 53*a* are preferably contiguous to and form a seal with the facing inner surfaces of the walls of the separation chamber 12. Alternatively, the outermost rods and their attached shields may form parts of the chamber walls. The magnetic fraction discharge channel 58*a* is provided below and in substantially vertical alignment with the liquid supply channel 58.

As indicated by the flow arrow 29, the material to be separated is delivered in the form of a slurry from the material feed channel 56 into the channel 57 leading to the nonmagnetic discharge channel, where the slurry enters the spaces 18 between the ferromagnetic rods 52 positioned at an acute angle to the direction of movement of the material to be concentrated. Magnetic particles (indicated by solid circles in FIG. 1) are deflected from the spaces 18 by magnetic forces directed outward from the spaces 18 and, as indicated by the flow arrow 31, are urged along the length of the spaces 18 towards the magnetic fraction discharge channel 58*a*. Nonmagnetic particles (indicated by open circles in FIG. 1) pass through the spaces 18 between the rods 52 and descend into the nonmagnetic fraction discharge channel 56*a*, as indicated by the flow arrow 33. It is preferable that the slurried material move through the spaces 18 between the ferromagnetic bodies 52 at a velocity such that the Reynolds number is below critical, in order to reduce cross contamination of the magnetic and nonmagnetic fractions.

The repulsive magnetic force directed outward from each space 18 between the ferromagnetic rods 52, being substantially stronger than the attractive magnetic force in such regions, is sufficient to prevent most magnetic particles from entering the spaces. With the plane A—A of the array of ferromagnetic rods disposed at an acute angle $\alpha$ to the exit direction, magnetic particles are prevented from accumulating in front of the spaces 18. Movement of the feed material in a continuous stream results in collisions which urge magnetic particles along the outer edges of the spaces 18 so that they join the separated fraction of magnetic particles.

Additionally, as a result of the orientation of the rods 52 with relation to the magnetic field, magnetic forces are generated in the spaces 18 between them directed outward from the spaces 18. Thus, errant magnetic particles which enter a space 18 between ferromagnetic rods are prevented from adhering to the rods by repulsive forces, which keep them well centered in such spaces.

In the embodiment of FIGS. 1 and 2, the movement of the particles is further aided by directing a liquid wash stream (indicated by the flow arrow 35) obliquely towards the plane of the forward edges of the array 14 of ferromagnetic rods 52, so that part of the wash stream moves through the stream of magnetic particles and aids in washing nonmagnetic particles into the spaces 18 between the rods. The nonmagnetic particles move through the spaces 18 into the discharge channel 56*a* for the nonmagnetic fraction. The stream of magnetic particles can be removed sufficiently far from the regions where nonmagnetic particles are separated out of the feed stream to reduce chances of cross contamination.

A divider 60 between the material feed stream and the liquid wash stream is placed so that it guides both the material feed stream and the wash stream in substantially vertical paths, indicated by the flow arrows 29 and 35. The length of the divider 60 is preferably such that the wash stream passes through the lower part of the magnetic fraction stream in order to wash away nonmagnetic particles and remove them through the spaces 18 between the ferromagnetic rods 52 into the nonmagnetic product. Although not shown in FIG. 1, one or more dividers could also be provided at the lower end of the array 14 to assist in guiding the magnetic particles into the discharge channel 58*a*.

Feeding of material by gravity in a substantially straight path, as shown in FIGS. 1 and 2, is also helpful in that it results in providing substantially uniform conditions along the entire length of each space between the ferromagnetic rods or plates.

It will be understood that where a liquid stream is not required or desirable, the liquid supply channel 58 and the divider 60 can be omitted.

In order to implement the process of the invention on a laboratory scale, a separator was developed comprising an electromagnetic circuit providing a horizontal magnetic field in its gap up to 1.3 tesla. The separator matrix was formed as a pair of ferromagnetic rods, 4 mm in diameter, installed with a 4 mm clearance between them. The rods were inclined at an angle α of 8° to the vertical. A nonmagnetic shield was attached to each rod on the side facing towards the feeder. The feeder was mounted above the rods and nonmagnetic product collection means were mounted on the opposite side of the rods and beneath them. The magnetic product bin was mounted on the same side of the plane of the rods as the feeder.

The laboratory separator was used to implement a wet separation process. Various mixtures used to test the process included (i) an artificial mixture of manganese oxide and quartz, (ii) weakly magnetic oxidized iron and manganese ores, (iii) quartz sand, (iv) titanium powder, and other materials. The particle size ranged from 0 to 1 mm. In a sample of manganese ore tested, for example, 7% of the particles were <0.3 mm in size, and in two other samples of the same ore 30% of the particles were <0.3 mm in size.

The process of the invention has been shown to have advantages over other known processes for concentrating components of natural ores and powders. When used to concentrate sand flotation tailings at a dressing mill, the process of the invention provided a yield of magnetic product amounting to 47% of the feed, compared to a yield for the Jones separator method, using plates with ridges and grooves, amounting to 33% of similar feed. Magnetic product contamination, as determined by reconcentration under the same process conditions, amounted, respectively, to 4% and 9%.

Figure 3:
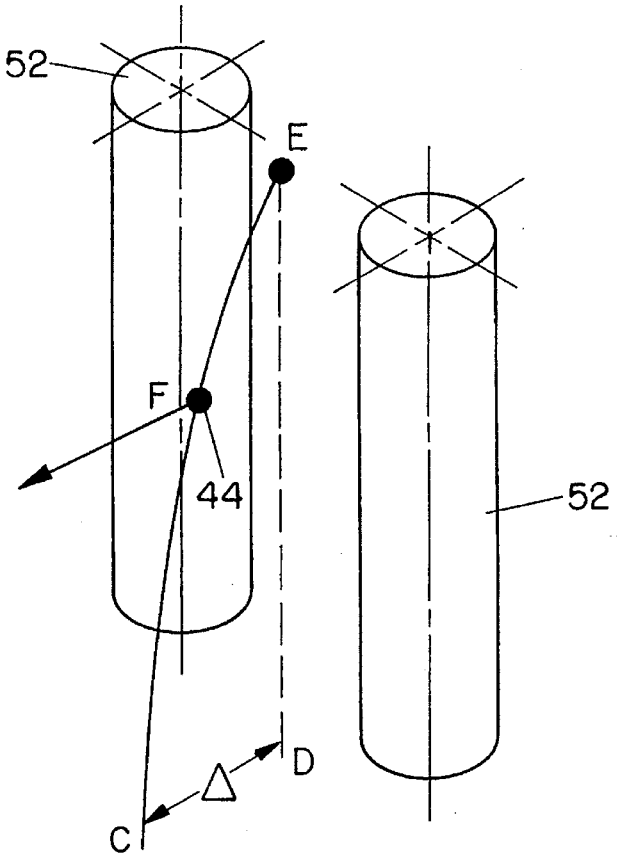
FIG. 3 illustrates the principle of operation of the deflecting magnetic force.
Figure 4:
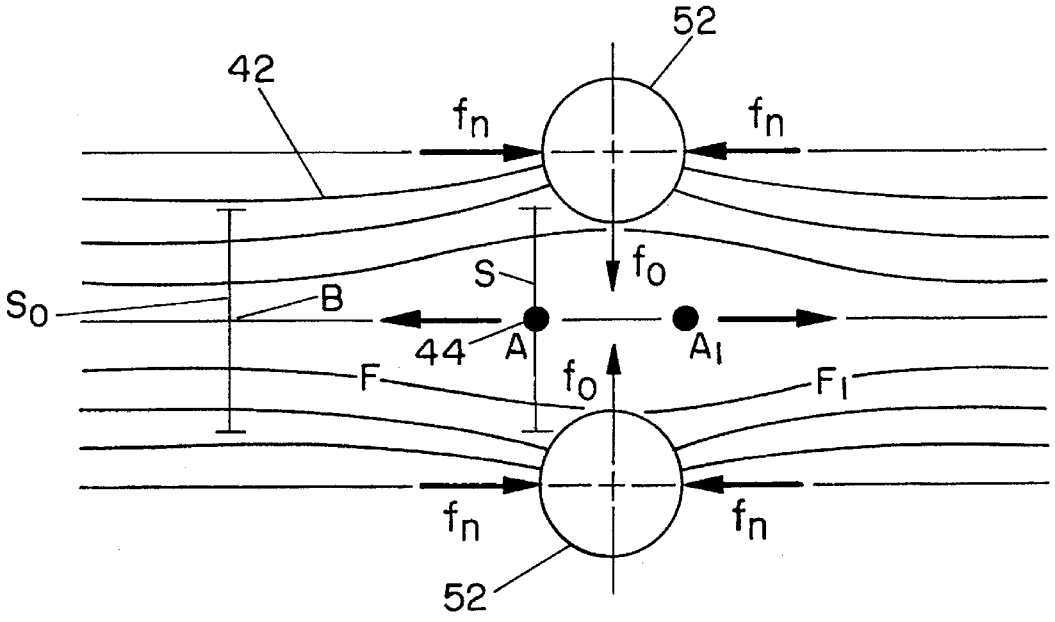
FIG. 4 is a diagram of a horizontal projection of magnetic force in the vicinity of the ferromagnetic bodies.

FIGS. 3 and 4 illustrate the principles of magnetism which underlie the invention. In these figures, reference numeral 52 represents ferromagnetic bodies in the form of rods positioned in a plane perpendicular to the magnetic field. In FIGS. 3 and 4, reference numeral 42 represents the magnetic flux lines and reference numeral 44 represents a magnetic particle. The magnetic flux lines close to the space between the rods 52 are deflected and concentrated in the rods 52, forming regions of attractive magnetic forces ($f_n$). Conversely, the rod surface segments facing towards the interior of the space constitute zones of repulsive magnetic forces ($f_o$).

If, as depicted in FIG. 1, the ferromagnetic rods are disposed at an angle of less than 90° to the direction of the magnetic flux lines, the foregoing explanation is still valid. In such case, however, the component of the magnetic field perpendicular to the rods must considered.

If, as shown in FIG. 4, a first control surface S and a second control surface $S_o$ at a distance therefrom, each of unit area and having their respective midpoints designated as points A and B, are selected in the space between the rods 52, more lines of magnetic flux pass through the surface $S_o$ than through the surface S. Thus, the magnetic field intensity is higher at point B than at point A. This results in magnetic field gradients in directions outward from the space, so that force F, also directed outward from the space (to the left in FIGS. 3 and 4), is exerted on magnetic particles. Force F causes the magnetic particle 44 to follow path EC (FIG. 3) which deviates by Δ from path ED that the particles would follow in the absence of the magnetic field. It should be noted that the deflecting force $F_1$ acting in the direction opposite to that of force F is exerted on the magnetic particle at point $A_1$.

Similarly, when the ferromagnetic bodies 52 are positioned so that their common tangential plane is oriented at an angle to the surface of the pole, a component of magnetic force is directed outward from the space between them.

The means and methods of the invention thus provide continuous separation with high output and little cross contamination for the reasons outlined below. With the tangential plane of the ferromagnetic bodies (rods, plates, etc.) at an appropriate angle to the field direction, repulsive magnetic forces arise which have a component directed outwards from the spaces between the bodies. Such forces have maximum value when the common tangential plane of the bodies is disposed at right angles to the field direction. Nonetheless, the plane is preferably disposed at an acute angle to the direction from the feeder to the nonmagnetic discharge channel. In a preferred arrangement, the magnetic field direction is horizontal and the material feed is vertical, whereby the angle of inclination of the ferromagnetic body plane to the feed direction is the same as the angle α between the plane and the perpendicular to the field direction. If the feed is vertical, the separation of the particles is assisted by gravity, which contributes to the efficiency of the separation.

Figure 5:
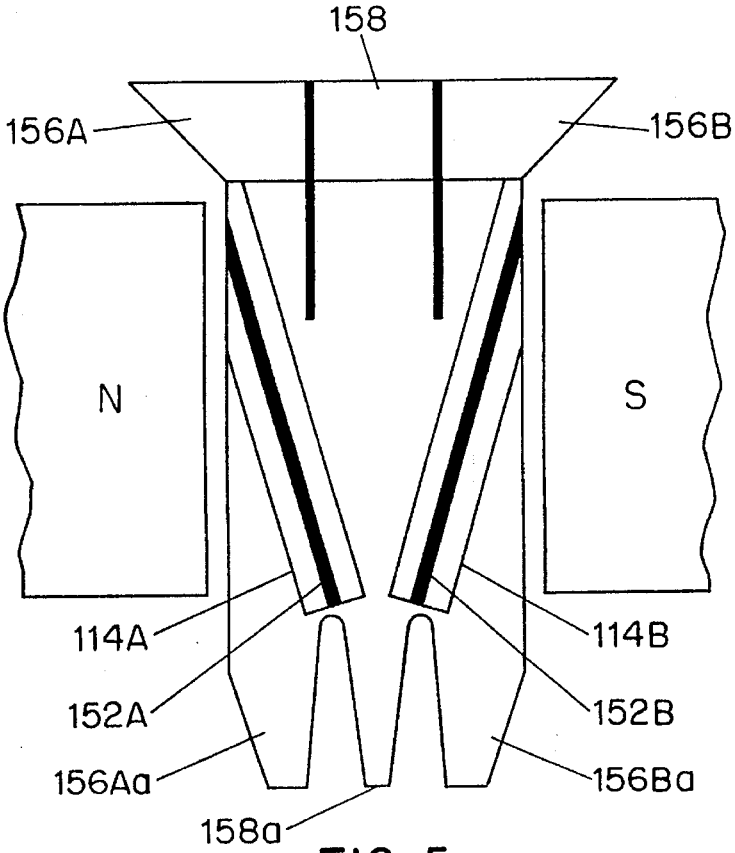
FIG. 5 is a schematic view of a second embodiment according to the present invention.

These concepts are equally applicable to the other embodiments of the invention shown in the drawings, where like parts are identified by like reference numbers increased by increments of 100. For example, FIG. 5 illustrates another embodiment of the invention in which a second array 114B of ferromagnetic rods 152B is rotated 180° about the vertical axis of the gap between the pole pieces and is mounted adjacent to the pole face opposite to the basic array 114A. Three input channels 156A, 156B, and 158 and three associated discharge channels 156A*a*, 156B*a*, and 158*a*, located substantially below the respective input channels, are provided in the embodiment of FIG. 5. The two outer input channels 156A and 156B are material input channels and the center channel 158 is a liquid input channel. As shown in FIG. 5, the left-hand array 114A of rods 152A extends between the input channel 156A and the discharge channel 156A*a*, the right-hand array 114B of rods extends between the input channel 156B and the discharge channel 156B*a*, and both arrays 114A and 114B are inclined towards the center exit channel 158*a*. The two outer discharge channels 156A*a* and 156B*a* receive the nonmagnetic particles from the material fed into the input channels 156A and 156B, respectively. The magnetic particles from both input channels 156A and 156B are received by the central discharge channel 158*a*.

Figure 6:
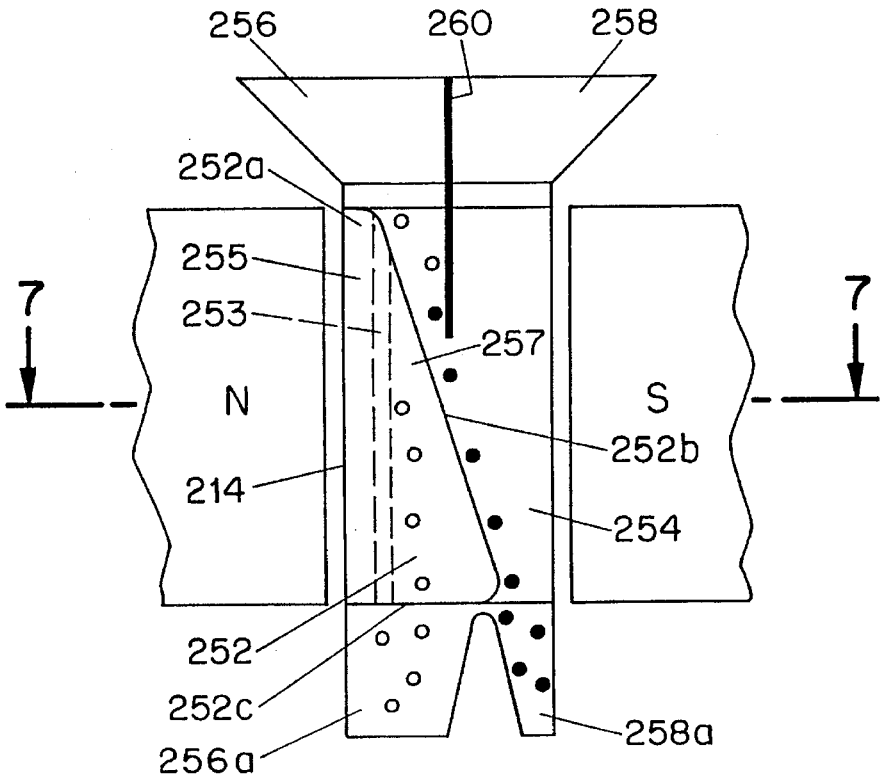
FIG. 6 is a schematic view of a third embodiment according to the present invention.

FIG. 6 illustrates a third embodiment of the invention in which an array 214 of triangular ferromagnetic plates 252 is provided instead of rods. The separator also comprises a material feed channel 256, a nonmagnetic fraction discharge channel 256*a*, a liquid supply channel 258 and a magnetic fraction discharge channel 258*a*. The feed channel 256 and the nonmagnetic discharge channel 256*a* connect to form channel 257. A divider 260 is placed between the feed channel and the liquid supply channel, extending into the separation chamber to a position such that it guides the wash liquid to encounter the deflected magnetic material where separation begins to take place.

Figure 7:
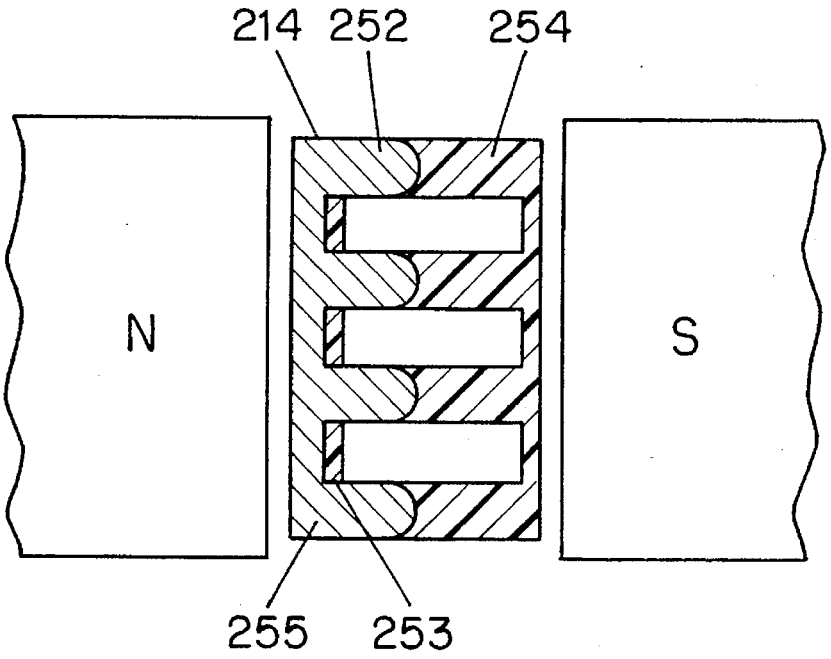
FIG. 7 is a sectional view taken along line 7—7 of FIG. 6 and looking in the direction of the arrows.

As shown in FIG. 6, the apex 252*a* of each plate 252 is near the upper end of the separation chamber into which material is fed. The junction between the front edge 252*b* and the base edge 252*c* of the triangle is near the lower end of the separation chamber and near the discharge channel 258*a* for magnetic particles. The front edge 252*b* of each plate is on the same side of a common plane A'—A' which is oriented at an angle substantially perpendicular to the magnetic field direction and at an acute angle to a vertical line from the feed channel 256 to the discharge channel 256*a* for nonmagnetic particles. The front edge 252*b* of each plate is rounded off in cross section, as is shown in FIG. 7. The front edge of each plate at the apex 252*a* and at the junction with the base edge 252*b* is shaped to form a second order convex curve having a suitable radius (>⅜ inch and preferably >½ inch). Alternatively, the front edge 252*b* at the junction with the base edge 252*c* may be shaped to form an isodynamic curve. The shape of an isodynamic curve is described in detail in U.S. Pat. No. 2,056,426 to S. G. Frantz, which is hereby incorporated by reference.

Figure 8:
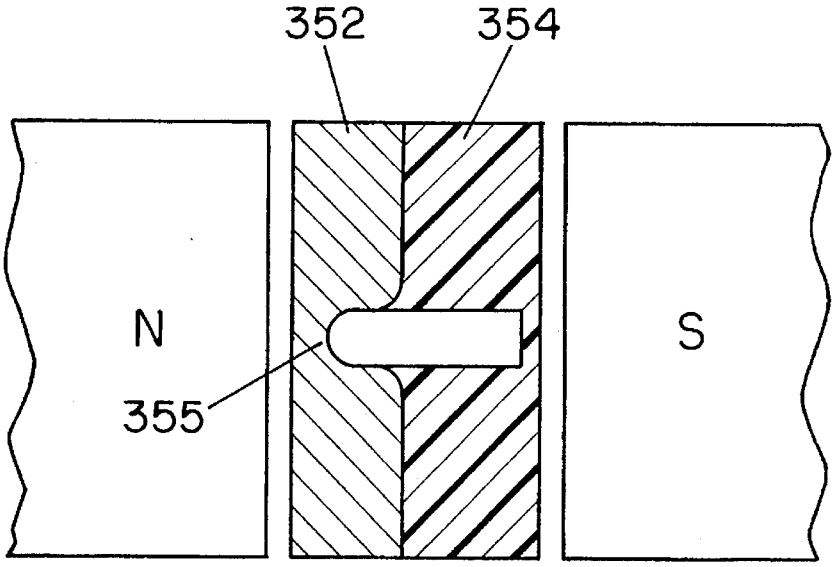
FIG. 8 is a sectional view of an alternative version of the third embodiment.

A nonmagnetic member 254 is fitted to the front edge of each triangular plate 252, the inner walls of such members 254 forming a channel equal in width to or narrower than the space between the plates. As shown in FIG. 7, the triangular plates 252 are joined by and form an integral whole with a back plate 255. In this embodiment, the separate nonmagnetic separation chamber 12, 112 shown in FIGS. 1, 2 and 5 is omitted and the outer surfaces of the outermost plates 252 (only two are shown in FIG. 7) and the outer surfaces of the nonmagnetic members 254 form the walls of the separation chamber. A thin nonmagnetic shield 253 is affixed to the inner surface of the back plate 255 in the spaces between the plates 252. Alternatively, as shown in FIG. 8, the back plate sections 355 between plates 352 may take the shape of a second-order concave curve in cross section. As also shown in FIG. 8, the width of the array of triangular plates 352 may be substantially equal to the width of the pole pieces.

Figure 9:
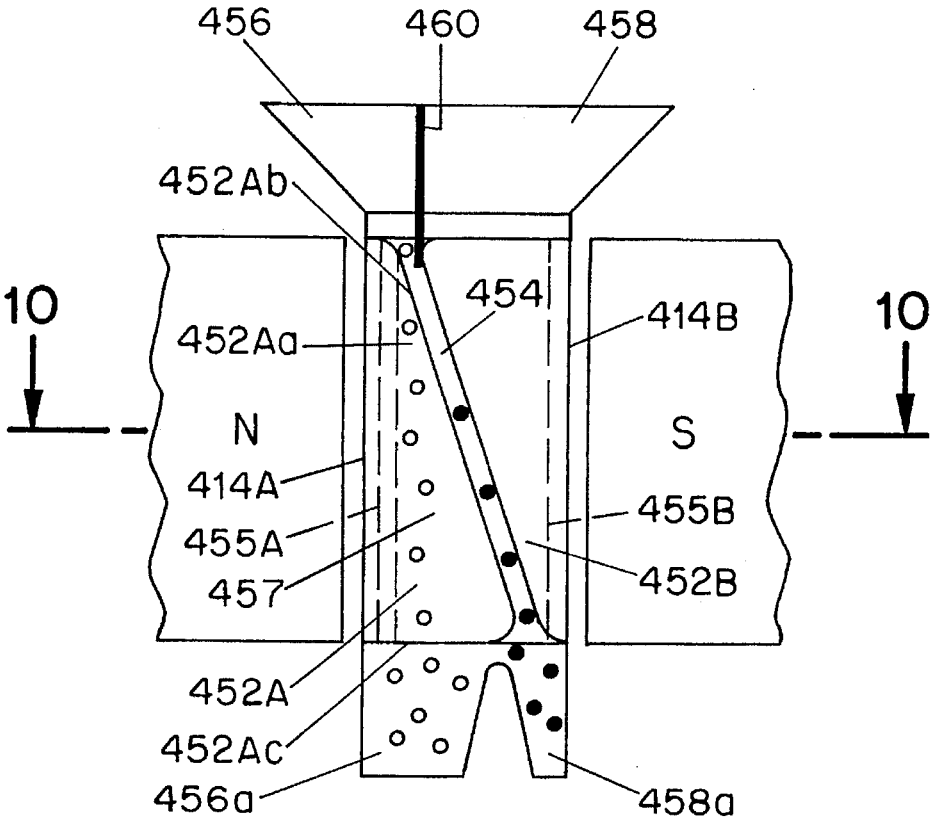
FIG. 9 is a schematic view of a fourth embodiment according to the present invention.
Figure 10:
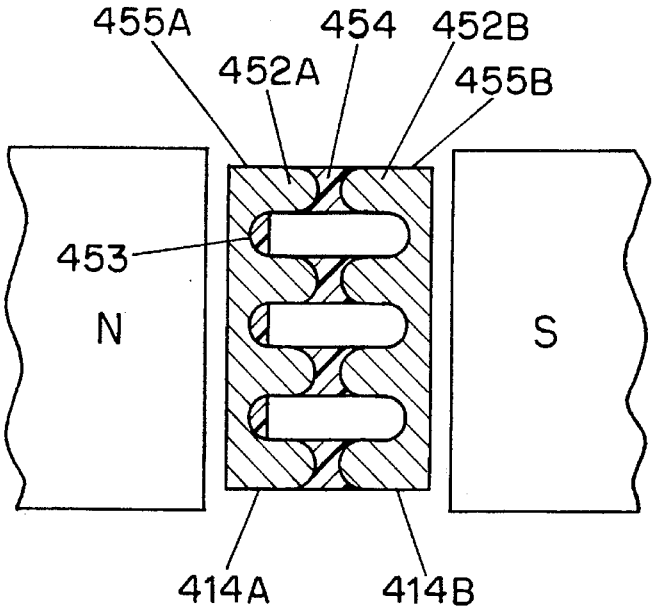
FIG. 10 is a sectional view taken along line 10—10 of FIG. 9 and looking in the direction of the arrows.

FIG. 9 illustrates a fourth embodiment of the invention, in which a second array 414B of triangular plates 452B similar to the array 214 shown in FIGS. 6 and 7, rotated 180° about the horizontal axis parallel to the pole faces passing through the center of the gap, is mounted adjacent to the pole face opposite to the basic array 414A. The separator also comprises a feed channel 456, a nonmagnetic fraction discharge channel 456*a*, a liquid supply channel 458 and a magnetic fraction discharge channel 458*a*. The feed channel 456 and the nonmagnetic fraction discharge channel 456*a* connect to form a channel 457. A nonmagnetic member 454 is fitted to the front edge of each plate of the arrays 414A and 414B. The inner surfaces of the members 454 form a channel equal in width or narrower than the space between the plates. As shown in FIG. 10, the triangular plates of each array 452A, 452B are joined by and form an integral whole with back plates 455A, 455B. Thin nonmagnetic shields 453 may be affixed to the back plate between plates.

Figure 11:
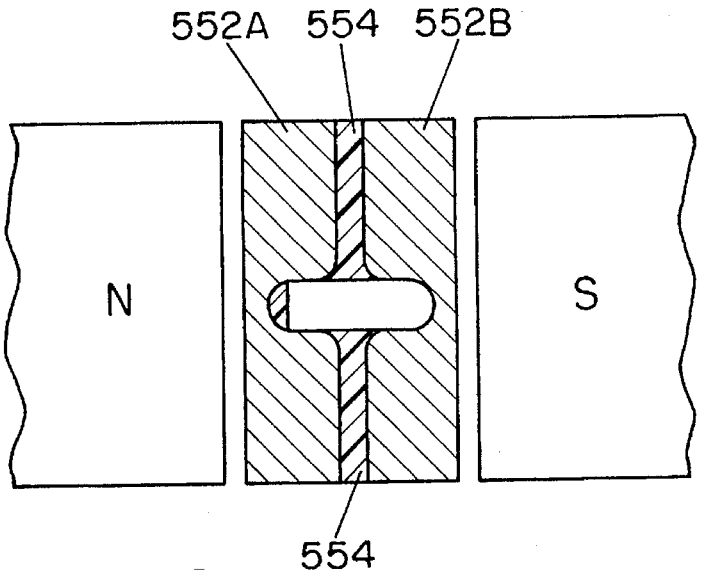
FIG. 11 is a sectional view of an alternative version of the fourth embodiment.

In an alternate embodiment shown in FIG. 11, the arrays of plates 552A and 552B have a width equal to the pole pieces.

Figure 12:
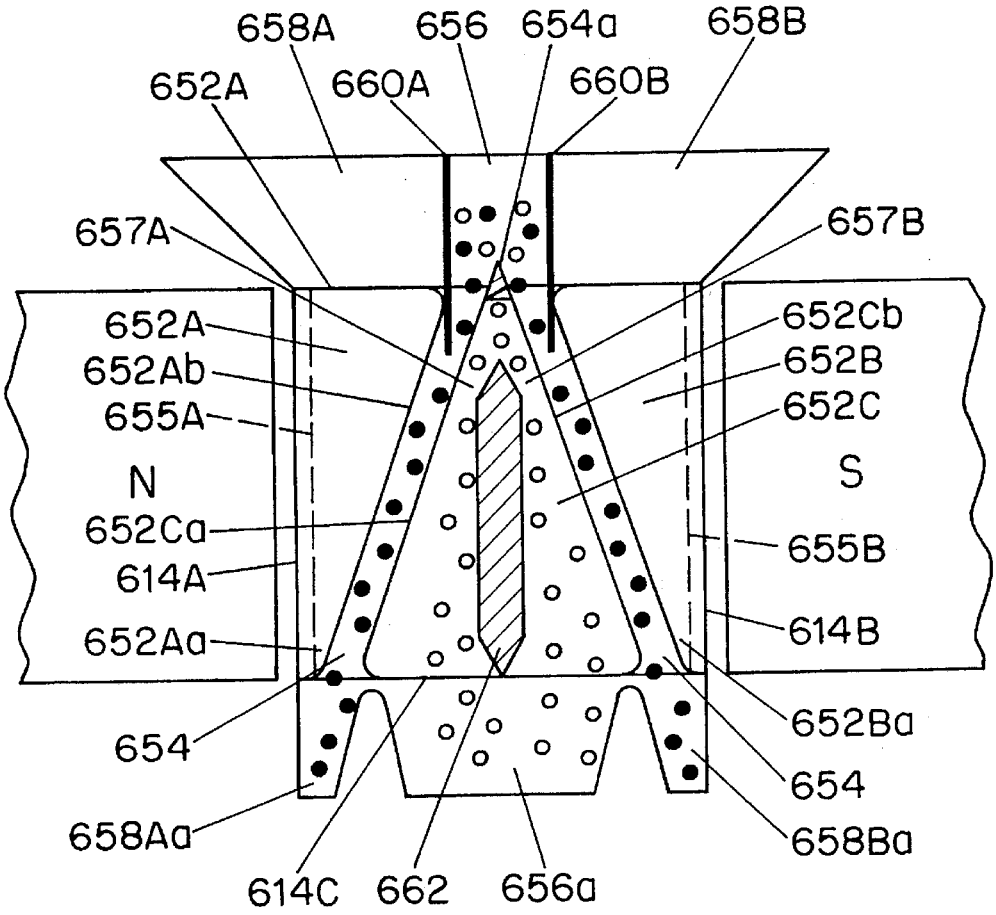
FIG. 12 is a schematic view of a fifth embodiment according to the present invention.

FIG. 12 illustrates a fifth embodiment of the invention, in which three arrays 614A, 614B, 614C of triangular ferromagnetic plates 652A, 652B, 652C are provided, the first array 614A being similar in shape to the basic array 214 shown in FIG. 6, but rotated 180° about the horizontal axis parallel to field direction so that the base edge 652A*c* of each plate of the first array is near the material feed end of the separation chamber and its front edge 652A*b* extends downward and outward towards the left hand poleface, joining the back plate 655A at the opposite end of the chamber. The second array 614B is similar in shape and position to the right hand array 414B shown in FIG. 9. The third array 614C, consisting of plates shaped as isosceles triangles, is placed between the first and second arrays. The isosceles edges 652C*a*, 652C*b* of each plate of the third array are fitted with nonmagnetic members 654 forming a channel equal in width to or narrower than the space between the plates, and extending the edges so that they converge to a point at the apex 654*a*. The separator also comprises a feed channel 656, a nonmagnetic particle discharge channel 656*a*, two liquid supply channels 658A, 658B and two magnetic particle discharge channels 658A*a*, 658B*a*.

Figure 13:
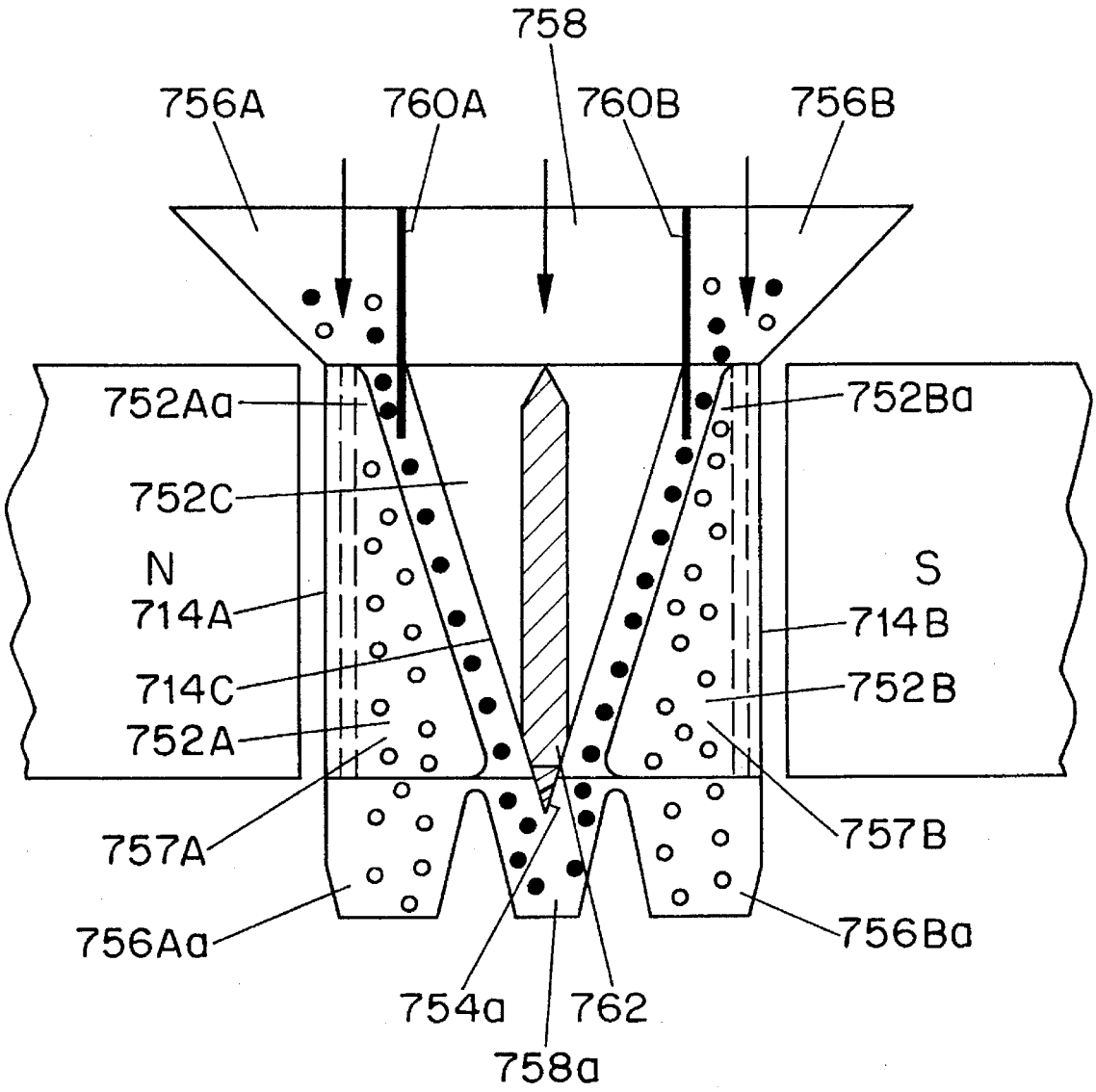
FIG. 13 is a schematic view of a sixth embodiment according to the present invention.

FIG. 13 illustrates a sixth embodiment of the invention, in which the three arrays 714A, 714B, 714C of triangular ferromagnetic plates similar in shape to those shown in FIG. 12 are rotated 180° about the horizontal axis parallel to field direction so that the apex 752A*a*, 752B*a* of each plate of the first and second arrays is near the upper end of the separating chamber and the apex 754*a* of the nonmagnetic members attached to the third array is inverted and near the opposite or lower end of the chamber. The separator also comprises two feed channels 756A, 756B separated by dividers 760A, 760B between them and a liquid supply channel 758, two nonmagnetic particle discharge channels 756A*a*, 756B*a*, and a magnetic particle discharge channel 758*a*.

The embodiments of FIGS. 12 and 13 have in common that in each the plates of the third array are joined together at the vertical axis by ferromagnetic bars 662, 762 which preferably form an integral whole therewith, that the plates of the three arrays and the spaces between them are aligned, and that nonmagnetic members fitted to the front edges of the first and second arrays are aligned with the nonmagnetic members fitted to the isosceles edges of the third array.

Although the invention has been described and illustrated herein by reference to specific embodiments thereof, such embodiments are susceptible of modification and variation without departing from the inventive concepts disclosed. For example, the method and apparatus can be modified so as to be suitable for separation of dry materials moved in a vacuum or a gaseous medium, or apparatus can be disposed so as to be suitable for separating material fed upwards or in any other direction. Also, the pole pieces may be omitted in magnetic systems, such as super conducting magnetic systems, in which they are not required to generate the magnetic field. All such modifications and variations, therefore, are intended to be encompassed within the spirit and scope of the appended claims.

What is claimed:

1. Apparatus for separating a flowable mixture of particles into magnetic and nonmagnetic fractions, comprising:

a magnetic circuit for generating a magnetic field of substantially uniform intensity throughout a region sufficient to accommodate at least one array of elongated ferromagnetic bodies;

a separation chamber comprised at least in part of nonmagnetic material located in said region, a first end of said chamber being at one end of said region and a second end of said chamber being at the other end of said region;

at least one particle feed channel adjacent the first end of the separation chamber for introducing a mixture to be separated into the separation chamber;

at least one array of ferromagnetic bodies forming part of or disposed within the separation chamber and extending between the first and second ends of the separation chamber, said array comprising (1) a plurality of elongated ferromagnetic bodies aligned in parallel, spaced apart relation on the same side of a common plane that is oriented substantially perpendicular to the direction of the magnetic field and at an acute angle to the direction of particle feed to the separation chamber through said at least one particle feed channel, and (2) an elongated nonmagnetic member adjoining each ferromagnetic body at least on the side thereof that faces the particle feed for guiding the mixture into the space between adjacent ferromagnetic bodies;

said orientation of the ferromagnetic bodies in the magnetic field giving rise to repulsive magnetic forces in the space between adjacent ferromagnetic bodies, a component of which acts in the direction of the magnetic field;

at least one discharge channel adjacent the second end of the separation chamber for collecting nonmagnetic particles, said at least one nonmagnetic particle discharge channel being located on the opposite side of said common plane from said at least one particle feed channel; and at least one discharge channel adjacent the second end of the separation chamber for collecting magnetic particles, said at least one magnetic particle discharge channel being located on the same side of said common plane as said at least one particle feed channel;

whereby nonmagnetic particles fed towards the ferromagnetic body array pass through the space between adjacent ferromagnetic bodies and enter the discharge channel for nonmagnetic particles while magnetic particles are deflected by said repulsive magnetic forces along the plane of the ferromagnetic bodies and enter the discharge channel for the magnetic particles.

2. The apparatus of claim 1, further comprising an elongated nonmagnetic member adjoining each ferromagnetic body on the side thereof facing away from the direction of particle feed towards the ferromagnetic body array.

3. The apparatus of claim 1 or 2 wherein the width of each nonmagnetic member in the direction transverse to the direction of particle feed towards the ferromagnetic bodies is at least as great as the width of the ferromagnetic body which it adjoins in said transverse direction.

4. The apparatus of claim 1 wherein the outer surfaces of the endmost ferromagnetic bodies in the array are contiguous to and sealed with the facing inner walls of the separation chamber.

5. The apparatus of claim 1, further comprising a wash liquid feed channel adjacent the first end of the separation channel for introducing a wash liquid stream into the separation chamber in a direction which intersects with the ferromagnetic body array over at least a portion of its length adjacent the second end of the separation chamber.

6. The apparatus of claim 5, wherein:

said at least one particle feed channel and said wash liquid feed channel are located in side-by-side relation in the direction of the magnetic field; and a divider member extends within the separation chamber transversely of the magnetic field over a portion of the length of the ferromagnetic body array adjacent the first end of the separation chamber, so as to guide the wash liquid stream towards said portion of the ferromagnetic body array adjacent the second end of the separation chamber.

7. The apparatus of claim 1, further comprising:

a second particle feed channel adjacent the first end of the separation chamber for introducing a mixture to be separated into the separation chamber, said second particle feed channel being spaced from said at least one particle feed channel in the direction of the magnetic field;

a second array of ferromagnetic bodies disposed within the separation chamber, said second array being substantially identical to said first array but rotated 180° about an axis perpendicular to the magnetic field direction and parallel to the common plane between the first and second ends of the chamber so as to be positioned such that the common plane of said second array is oriented substantially perpendicular to the direction of the magnetic field and at an acute angle to the direction of particle feed to the separation chamber through said second particle feed channel;

the end of said second ferromagnetic body array adjacent to the second end of the separation chamber being aligned to deliver magnetic particles to said magnetic particle discharge channel; and a second discharge channel adjacent the second end of the separation chamber for collecting nonmagnetic particles introduced through second particle feed channel.

8. The apparatus of claim 7, further comprising a wash liquid feed channel adjacent the first end of the separation chamber, said wash liquid feed channel being located between said at least one particle feed channel and said second particle feed channel and in substantial alignment with said magnetic particle discharge channel.

9. The apparatus of claim 1 or 7, wherein the ferromagnetic bodies comprise elongated rods.

10. The apparatus of claim 1 or 7 wherein the ferromagnetic bodies comprise elongated plates.

11. The apparatus of claim 10, wherein the elongated plates are substantially triangular in shape having front, back and base edges, the junctures between the front and back edges of the plates being adjacent to the first end of the separation chamber, the back edges of the plates being adjacent to a wall of the chamber extending from the first to the second end of the chamber, the front edges of the plates extending inward from said wall toward the center of the chamber, and the base edges of said plates being adjacent to the second end of the chamber, the junctures between the front and base edges of the plates being adjacent to the second end of the chamber and in alignment with the magnetic particle discharge channel, the front edges of the plates lying in said common plane and being rounded off in cross section.

12. The apparatus of claim 11, wherein the back edges of the triangular plates are joined by a common ferromagnetic back plate.

13. The apparatus of claim 12, wherein the inwardly facing surface of the back plate between adjacent plates has the shape of a second order curve in transverse cross section.

14. The apparatus of claim 11, wherein the nonmagnetic member adjoining the front edge of each plate is at least as wide, in the direction transverse to the direction of particle feed towards the plates, as the width, in said transverse direction, of the plate, thereby forming a flow channel between adjacent plates of a width, in said transverse direction, equal to or less than the spacing between the plates.

15. The apparatus of claim 12, further comprising a thin nonmagnetic shield on the inwardly facing surface of the back plate between adjacent plates.

16. The apparatus of claim 1 or 7 wherein the width of each ferromagnetic body array, in the direction transverse to the direction of particle feed towards the ferromagnetic bodies, is substantially equal to the width, in said transverse direction, of the field region.

17. The apparatus of claims 1 or 7, wherein the width of each ferromagnetic body, in the direction transverse to the direction of particle feed towards the ferromagnetic bodies, is approximately equal to the distance, in said transverse direction, between adjacent ferromagnetic bodies.

18. The apparatus of claim 1 or 7, wherein the common plane of each ferromagnetic body array is inclined relative to the perpendicular to the direction of the magnetic field at an angle within the range of from 2° to 15°.

19. The apparatus of claim 18, where said angle of inclination is within the range of from 4° to 10°.

20. The apparatus of claim 1 or 7, wherein:

the magnetic circuit is arranged to generate a substantially horizontally extending magnetic field;

each particle feed channel is located above the separation chamber and is arranged to introduce particles into the separation chamber in a substantially vertical direction;

the common plane of each ferromagnetic body array is inclined at an acute angle to the vertical;

each nonmagnetic particle discharge channel is located below the separation chamber in substantially vertical alignment with a particle feed channel; and each magnetic particle discharge channel is located below the separation chamber in substantially vertical alignment with the lower end of a ferromagnetic body array.

21. The apparatus of claim 20, wherein the common plane of each ferromagnetic array is inclined relative to the vertical at an angle within the range of from 2° to 15°.

22. The apparatus of claim 21, wherein said angle of inclination is within the range of from 4° to 10°.

23. The apparatus of claim 7, wherein:

the elongated bodies of said at least one and said second arrays of ferromagnetic bodies comprise substantially triangular plates having front, back and base edges, the junctures between the front and back edges of the plates of said at least one and said second arrays being adjacent to the first end of the separation chamber and in alignment with said at least one particle feed channel and said second particle feed channel, respectively, the back edges of the plates of said at least one and said second arrays being adjacent to respective walls of the separation chamber extending from the first end to the second end of the separation chamber and the base edges of the plates of said at least one and said second arrays being adjacent to the second end of the chamber, the front edges of the plates of said at least one and said second arrays extending inward from said respective walls toward the center of the chamber, the junctures between the front and base edges of the plates of said at least one and said second arrays being in alignment with the magnetic particle discharge channel, and the front edge of each plate of said at least one and said second arrays lying on said one side of said common plane of each array;

said at least one magnetic particle discharge channel is located between said at least one and said second nonmagnetic discharge channels; and said apparatus further comprises a third array of ferromagnetic plates located between said at least one and said second arrays of plates, the ferromagnetic plates of said third array each comprising a substantially isosceles-shaped triangle having two isosceles edges and a base edge, the isosceles edges of said third array of plates lying on one side of respective common planes, one of which is parallel to the common plane of the front edges of the plates of said at least one array and the other of which is parallel to the common plane of the front edges of the plates of said second array, the junctures of the isosceles edges of the plates of said third array being located adjacent to the second end of said separation chamber and in alignment with the magnetic particle discharge channel, the base edges of the plates of said third array being located adjacent the first end of said separation chamber and between said at least one and said second particle feed channels.

24. The apparatus of claim 23, further comprising:

an elongated nonmagnetic member adjoining each isosceles edge of each plate of said third array; and the plates and nonmagnetic members of said at least one, second and third arrays and the spaces therebetween being mutually aligned in the direction of the magnetic field.

25. The apparatus of claim 24, wherein the nonmagnetic members adjoining the isosceles edges of the plates of said third array form flow channels between adjacent plates of said third array of a width equal to or less than the spacing between the plates.

26. The apparatus of claim 25, wherein the nonmagnetic members adjoining the isosceles edges of each plate of said third array extend said isosceles edges so that they converge to a point at the apex therebetween.

27. The apparatus of claim 23, further comprising:

a wash liquid feed channel adjacent the first end of the separation chamber in substantial alignment with the base edges of the plates of said third array; and a divider member located at each side of said liquid feed channel and extending into the separation chamber transversely of the magnetic field to a distance beyond the junctures of the isosceles edges and the base edges of the plates of said third array.

28. The apparatus of claim 23, wherein the front edge of each plate of said at least one and said second arrays is rounded off in cross section.

29. The apparatus of claim 23, wherein the plates of at least said third array are joined together in the direction perpendicular to the direction of the magnetic field by one or more ferromagnetic members.

30. The apparatus of claim 1, wherein:

the elongated ferromagnetic bodies of said at least one array of ferromagnetic bodies each comprise a substantially isosceles-shaped triangle having two isosceles edges and a base edge, the isosceles edges of said at least one array of plates lying on one side of respective common planes that are oriented substantially perpendicular to the direction of the magnetic field and at an acute angle to the first particle feed path, the junctures between the isosceles edges of the plates of said at least one array being located adjacent to the first end of the separation chamber and in alignment with said at least one particle feed channel, the base edges of the plates of said at least one array being located adjacent the second end of the separation chamber;

said at least one magnetic particle discharge channel being located in alignment with the junctures of one isosceles edge and the base edge of the plates of said at least one array;

said apparatus further comprises a second magnetic particle discharge channel adjacent the second end of said separation chamber in alignment with the junctures of the other isosceles edge and the base edge of the plates of said at least one array;

said at least one nonmagnetic discharge channel being located between said at least one and said second magnetic particle discharge channels in alignment with the base edges of the plates of said at least one array.

31. The apparatus of claim 30, further comprising:

second and third arrays of substantially triangular ferromagnetic plates having front, back and base edges, the junctures of the front and back edges of the plates of the second and third arrays being located adjacent the second end of the separation chamber in alignment with said at least one and said second magnetic particle discharge channels, respectively, the base edges of the plates of said second and third arrays being located adjacent the first end of the separation chamber on either side of said at least one particle feed channel, and the respective front edges of the plates of said second and third arrays extending generally parallel to respective isosceles edges of the plates of said at least one array.

32. The apparatus of claim 31, further comprising:

an elongated nonmagnetic member adjoining the front edge of each of the plates of said second and third arrays; and the plates and nonmagnetic members of said at least one, second and third arrays and the spaces therebetween being mutually aligned in the direction of the magnetic field.

33. The apparatus of claim 32, wherein the nonmagnetic members adjoining the isosceles edges of the plates of said at least one array form flow channels between adjacent plates of said at least one array of a width equal to or less than the spacing between the plates.

34. The apparatus of claim 33, wherein the nonmagnetic members adjoining the isosceles edges of each plate of said at least one array extend said isosceles edges so that they converge to a point at the apex therebetween.

35. The apparatus of claim 31, further comprising:

two wash liquid feed channels adjacent the first end of the separation chamber, one located on either side of said at least one particle feed channel in substantial alignment with the base edges of the plates of the second and third arrays; and a divider member located at each side of said at least one particle feed channel and extending into the separation chamber to a distance beyond the junctures of the isosceles edges of the plates of said at least one array.

36. The apparatus of claim 31, wherein the front edge of each plate of said at least one array is rounded off in cross section.

37. The apparatus of claim 31, wherein the plates of at least said at least one array are joined together in the direction perpendicular to the direction of the magnetic field by one or more ferromagnetic members.

38. A method for separating a flowable mixture of particles into magnetic and nonmagnetic fractions, comprising the steps of:

generating a magnetic field of substantially uniform intensity throughout a region sufficient to accommodate at least one array of elongated ferromagnetic bodies;

providing in said field region a separation chamber comprised at least in part of nonmagnetic material, having a first end at one end of said region and a second end at the other end of said region;

introducing a mixture stream to be separated into the separation chamber through at least one particle feed channel located adjacent the first end of the separation chamber;

providing at least one array of ferromagnetic bodies within the separation chamber and extending between the first and second ends of the separation chamber, said array comprising (1) a plurality of elongated ferromagnetic bodies aligned in parallel, spaced apart relation on the same side of a common plane that is oriented substantially perpendicular to the direction of the magnetic field between the pole faces and at an acute angle to the direction of particle feed to the separation chamber, and (2) an elongated nonmagnetic member adjoining each ferromagnetic body at least on the side thereof that faces the particle feed for guiding the mixture into the space between adjacent ferromagnetic bodies;

said orientation of the ferromagnetic bodies in the magnetic field giving rise to repulsive magnetic forces in the space between adjacent ferromagnetic bodies, a component of which acts in the direction of the magnetic field;

collecting nonmagnetic particles through at least one discharge channel located at the second end of the separation chamber on the opposite side of said common plane from said at least one particle feed channel; and collecting magnetic particles through at least one discharge channel located adjacent the second end of the separation chamber on the same side of said common plane as said at least one particle feed channel;

whereby nonmagnetic particles fed towards the ferromagnetic body array pass through the space between adjacent ferromagnetic bodies and enter the discharge channel for nonmagnetic particles while magnetic particles are deflected by said repulsive magnetic forces along the plane of the ferromagnetic bodies and enter the discharge channel for the magnetic particles.

39. The method of claim 38, further comprising:

introducing a second mixture stream to be separated into the separation chamber through a second particle feed channel at the first end of the separation chamber;

providing a second array of ferromagnetic bodies within the separation chamber, said second array being substantially identical to said first array but rotated 180° about an axis perpendicular to the magnetic field direction and parallel to the common plane between the first and second ends of the chamber such that the common plane of said second array is oriented substantially perpendicular to the direction of the magnetic field and at an acute angle to the direction of particle feed to the separation chamber through said second particle feed channel;

the end of said second ferromagnetic body array adjacent to the second end of the separation chamber being aligned to deliver magnetic particles to said magnetic particle discharge channel; and collecting nonmagnetic particles from said second mixture stream through a second discharge channel located at the second end of the separation chamber on the same side of the common plane of said second array as said second particle feed channel.

40. The method of claim 38 or 39, wherein each ferromagnetic body array further comprises an elongated nonmagnetic member adjoining each ferromagnetic body on the side thereof facing away from the direction of particle feed towards the ferromagnetic body array.

41. The method of claim 38 or 39, wherein the mixture to be separated comprises a slurry.

42. The method of claim 38 or 39, further comprising introducing a wash liquid stream into the separation chamber through a wash liquid feed channel located at the first end of the separation chamber in a direction which intersects with the ferromagnetic body array or arrays over at least a portion of their length.

43. The method of claim 42, further comprising guiding said wash liquid stream so that it encounters the mixture to be separated at a point beyond the point at which separation of the particles into magnetic and nonmagnetic fractions begins to take place.

44. The method of claim 38 or 39, wherein the mixture to be separated is introduced into the separation chamber in a substantially vertical direction, whereby particle flow through the separation chamber is aided by gravity.

45. The method of claim 44; wherein the common plane of each ferromagnetic body array is inclined relative to the feed direction at an angle within the range of from 2° to 15°.

46. The method of claim 45, wherein said angle of inclination is within the range of from 4° to 10°.

47. The method of claim 41, wherein the flow rate of the slurry through the space between adjacent ferromagnetic bodies is maintained at a velocity such that the Reynolds number is below the critical value.

48. The method according to claims 38 or 39, wherein the material to be separated is fed into the chamber in gaseous suspension.

* * * * *

UNITED STATES PATENT AND TRADEMARK OFFICE

CERTIFICATE OF CORRECTION

PATENT NO. : 5,568,869

DATED : October 29, 1996

INVENTOR(S) : Alexander M. Turkenich et al.

It is certified that error appears in the above-indentified patent and that said Letters Patent is hereby corrected as shown below:

Cover Page: Item [56], insert after the eighth line:
--FOREIGN PATENT DOCUMENT
9116985 11/1991 W.O. ..... 209/212—;
under "OTHER PUBLICATIONS", "K. Schonert al. al." should read --K. Schonert et al.--;
last line of the first column, "Mineral Procressing" should read --Mineral Processing--;
7th from bottom line of ABSTRACT, " means " should read --a discharge channel--;
Col. 9, line 44, "must" should read --must be--.

Signed and Sealed this

Fourth Day of March, 1997

Bruce Lehman

*Attest:*

BRUCE LEHMAN

*Attesting Officer*

*Commissioner of Patents and Trademarks*